US010210819B2

(12) United States Patent
Zhan et al.

(10) Patent No.: US 10,210,819 B2
(45) Date of Patent: Feb. 19, 2019

(54) TUNABLE BACKLIGHT DEVICE, A DISPLAY DEVICE AND A METHOD OF DRIVING THE SAME

(71) Applicants: BOE TECHNOLOGY GROUP CO., LTD., Beijing (CN); Hefei BOE Optoelectronics Technology Co., Ltd., Hefei, Anhui (CN)

(72) Inventors: Jianghui Zhan, Beijing (CN); Ming Fang, Beijing (CN); Chang LV, Beijing (CN); Park Jinmoo, Beijing (CN); Shounian Chen, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 171 days.

(21) Appl. No.: 14/912,857

(22) PCT Filed: Aug. 11, 2015

(86) PCT No.: PCT/CN2015/086652
§ 371 (c)(1),
(2) Date: Feb. 18, 2016

(87) PCT Pub. No.: WO2016/127609
PCT Pub. Date: Aug. 18, 2016

(65) Prior Publication Data

US 2016/0358556 A1 Dec. 8, 2016

(30) Foreign Application Priority Data

Feb. 13, 2015 (CN) ..... 2015 1 0080914

(51) Int. Cl.
*G09G 3/36* (2006.01)
*G09G 3/34* (2006.01)
*G09G 3/20* (2006.01)

(52) U.S. Cl.
CPC ..... *G09G 3/3413* (2013.01); *G09G 3/2003* (2013.01); *G09G 3/3648* (2013.01);
(Continued)

(58) Field of Classification Search
None
See application file for complete search history.

(56) References Cited

U.S. PATENT DOCUMENTS

2005/0263674 A1* 12/2005 Lee ..... G01J 3/46 250/205
2007/0103934 A1* 5/2007 Keh ..... G02B 6/0068 362/612

(Continued)

FOREIGN PATENT DOCUMENTS

CN 1621903 A 6/2005
CN 101154351 A 4/2008

(Continued)

OTHER PUBLICATIONS

Second Chinese Office Action, for Chinese Patent Application No. 2015100809148, dated Jan. 13, 2017.

(Continued)

*Primary Examiner* — Ifedayo B Iluyomade
(74) *Attorney, Agent, or Firm* — Kinney & Lange, P.A.

(57) ABSTRACT

The present disclosure provides a tunable backlight device, a display device and method of driving the display device. The tunable backlight device comprises: at least one backlight apparatus with high color gamut and low luminance; at least one backlight apparatus with low color gamut and high luminance; a storage configured to store a library of current (Continued)

feedback coefficients; a current feedback apparatus, configured to determine a first current feedback coefficient (K1) for the backlight apparatus with high color gamut and low luminance and a second current feedback coefficient (K2) for the backlight apparatus with low color gamut and high luminance, according to the requirements, respectively; a backlight driving apparatus configured to supply respective currents to both the backlight apparatuses to emit lights, based on the first and the second current feedback coefficients, respectively; and a light guide plate configured to mix the lights emitted from the both backlight apparatuses.

13 Claims, 4 Drawing Sheets

(52) U.S. Cl.
CPC ..... *G09G 2320/0646* (2013.01); *G09G 2320/0666* (2013.01); *G09G 2320/08* (2013.01); *G09G 2360/16* (2013.01)

(56) References Cited

U.S. PATENT DOCUMENTS

2016/0086551 A1* 3/2016 Matsui ..... G09G 3/3413 345/690
2016/0117970 A1* 4/2016 Matsui ..... G09G 3/3406 345/690
2016/0238774 A1* 8/2016 Koike ..... G02B 6/0043

FOREIGN PATENT DOCUMENTS

| | | | | | |
|---|---|---|---|---|---|
| CN | 101546521 | A | | 9/2009 | |
| CN | 102287709 | A | | 12/2011 | |
| CN | 102414733 | A | | 4/2012 | |
| CN | 103165081 | A | | 6/2013 | |
| CN | 203442606 | U | | 2/2014 | |
| CN | 103629603 | A | | 3/2014 | |
| CN | 104599643 | A | | 5/2015 | |
| JP | WO2014188533 | | * | 11/2014 | G09G 3/34 |
| JP | WO2014192148 | | * | 12/2014 | G09G 3/20 |
| JP | WO2015030037 | | * | 3/2015 | G02B 6/00 |
| KR | 20110026754 | A | | 3/2011 | |
| TW | 200938910 | A | | 9/2009 | |
| WO | PCT/JP2013064192 | | * | 5/2013 | G09G 3/34 |
| WO | PCT/JP2013065244 | | * | 5/2013 | G09G 3/20 |

OTHER PUBLICATIONS

First Chinese Office Action, for Chinese Patent Application No. 2015100809148, dated Jul. 8, 2016, 13 pages.
International Search Report and Written Opinion (including English translation of Box V.) dated Nov. 6, 2015, for corresponding PCT Appln. No. PCT/CN2015/086652.

* cited by examiner

TUNABLE BACKLIGHT DEVICE, A DISPLAY DEVICE AND A METHOD OF DRIVING THE SAME

CROSS-REFERENCE TO RELATED APPLICATION(S)

This application is a Section 371 National Stage Application of International Application No. PCT/CN2015/086652, filed on 11 Aug. 2015, and claims priority to Chinese Application No. 201510080914.8, filed on 13 Feb. 2015, incorporated herein by reference in their entirety.

TECHNICAL FIELD

The present application relates to a field of display devices, and more particularly, to a backlight device with a tunable color gamut and luminance, a display device and a method of driving the display device.

BACKGROUND

Screens of Liquid crystal displays (LCD) may filter a backlight during displaying. Therefore, a color gamut of the LCD depends on a spectrum of the backlight. Generally, a high color gamut LED has a low luminance, while a high color gamut LED has a high luminance. If the high color gamut and the high luminance are both required, it will lead to an increased cost and an increased power consumption.

A product with high color gamut is a trend for a liquid crystal display product. However, such products normally have a low luminance due to a low transmission of the liquid crystal display panel or a low luminance of a high color gamut light-emitting diode used. In addition, user wants that displaying effects will be changed with an external environment. For example, in a sunny outdoor condition, the user may expect a high luminance so as to view the display screen clearly; and in an indoor condition, the user may expect a high color gamut. In view of this, the conventional liquid crystal display cannot meet the user's demand under different situations in the aspect of color gamut.

SUMMARY

According to one aspect of the application, a tunable backlight device is provided, comprising: at least one backlight apparatus with a high color gamut and a low luminance; at least one backlight apparatus with low color gamut and high luminance; a storage, configured to store a library of current feedback coefficients; a current feedback apparatus, configured to determine a first current feedback coefficient for the backlight apparatus with high color gamut and low luminance, and a second current feedback coefficient for the backlight apparatus with low color gamut and high luminance, from the library of current feedback coefficients, respectively, according to requirements on chromaticity and luminance; a backlight driving apparatus, configured to supply respective currents to the backlight apparatus with high color gamut and low luminance and the backlight apparatus with low color gamut and high luminance to emit lights, based on the first and the second current feedback coefficients, respectively; and a light guide plate, configured to mix the lights emitted from the backlight apparatus with high color gamut and low luminance with the lights emitted from the backlight apparatus with low color gamut and high luminance.

According to another aspect of the application, a display device is provided, comprising: a tunable backlight device as discussed above; and an input unit, configured to input requirements on chromaticity and luminance.

According to another aspect of the application, a method of driving a tunable backlight device is provided, comprising: receiving requirements on chromaticity and luminance; providing a first current feedback coefficient to a backlight apparatus with high color gamut and low luminance, and providing a second current feedback coefficient to a backlight apparatus with low color gamut and high luminance respectively, based on the requirements on chromaticity and luminance; supplying respective currents to the backlight apparatus with high color gamut and low luminance and the backlight apparatus with low color gamut and a high luminance, based on the first and the second current feedback coefficients, respectively; and emitting lights by the backlight apparatus with high color gamut and low luminance and the backlight apparatus with low color gamut and high luminance based on the first and the second current feedback coefficients, respectively; and mixing the lights emitted from the backlight apparatus with high color gamut and low luminance and the light emitted from the backlight apparatus with low color gamut and high luminance by a light guide plate.

According to another aspect of the application, a method of driving a tunable backlight device is provided, comprising: acquiring a preset scene to be displayed; providing a first current feedback coefficient to a backlight apparatus with high color gamut and low luminance, and providing a second current feedback coefficient to a backlight apparatus with low color gamut and high luminance respectively, based on the preset scene; supplying respective currents to the backlight apparatus with high color gamut and low luminance and the backlight apparatus with low color gamut and high luminance to emit lights, based on the first and the second current feedback coefficients, respectively; and mixing the lights emitted from the backlight apparatus with high color gamut and low luminance with the lights emitted from the backlight apparatus with low color gamut and high luminance by a light guide plate.

BRIEF DESCRIPTION OF THE DRAWINGS

The above and other objects, features, and advantages of the present disclosure will become apparent from the following descriptions on embodiments of the present disclosure with reference to the drawings, in which.

DETAILED DESCRIPTION OF EMBODIMENTS

Figure 1:
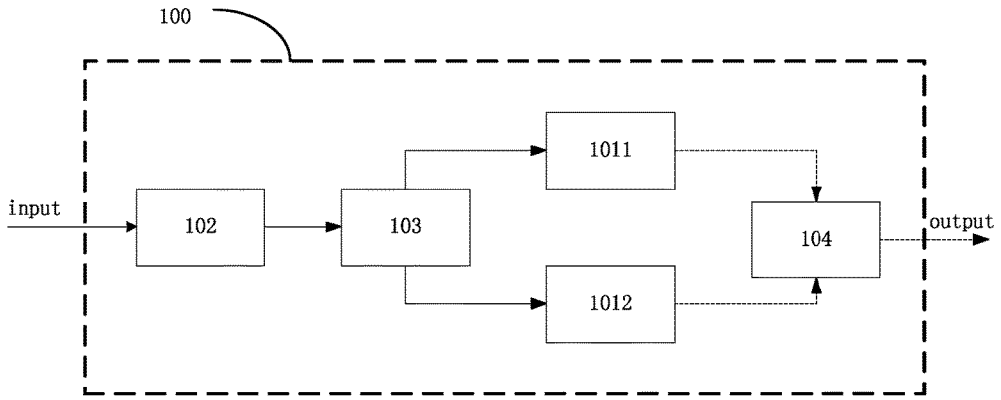
FIG. 1 illustrates a schematic diagram of a tunable backlight device 100 according to the embodiment of the disclosure.

Reference is now made to the embodiments of the disclosure, and the examples of which are illustrated in the drawings. Throughout the drawings, the same reference signs are generally used to refer to corresponding or similar elements. Embodiments of the disclosure will be described with reference to the drawings.

FIG. 1 illustrates a schematic diagram of the tunable backlight device 100 according to the embodiment of the disclosure. As shown in FIG. 1, the tunable backlight device 100 may comprise: at least one backlight apparatus with high color gamut and low luminance 1011; at least one backlight apparatus with low color gamut and high luminance 1012; a current feedback apparatus 102, configured to determine a first current feedback coefficient (K1) provided for the backlight apparatus with high color gamut and low luminance, and a second current feedback coefficient (K2) provided for the backlight apparatus with low color gamut and high luminance respectively, according to the requirements on chromaticity and luminance; a backlight driving apparatus 103, configured to supply respective currents to the backlight apparatus with high color gamut and low luminance 1011 and the backlight apparatus with low color gamut and high luminance 1012 to emit lights, based on the first and the second current feedback coefficients, respectively; and a light guide plate 104, configured to mix the lights emitted from the backlight apparatus with high color gamut and low luminance with the lights emitted from the backlight apparatus with low color gamut and high luminance. Finally, the backlight of the LED display device is achieved by using the lights mixed via the light-guide plate 104 for illuminating. As shown in FIG. 1, the current feedback apparatus 102 may provide current feedback coefficients, and offer the current feedback coefficients to the backlight driving apparatus 103. A solid arrow in FIG. 1 refers to an electrical signal, while a dotted arrow refers to an optical signal.

In particular, a light source provided in the backlight apparatus with high color gamut and low luminance 1011 and a light source provided the backlight apparatus with low color gamut and high luminance 1012 may be a same light-emitting diode, or different light-emitting diodes.

Figure 2:
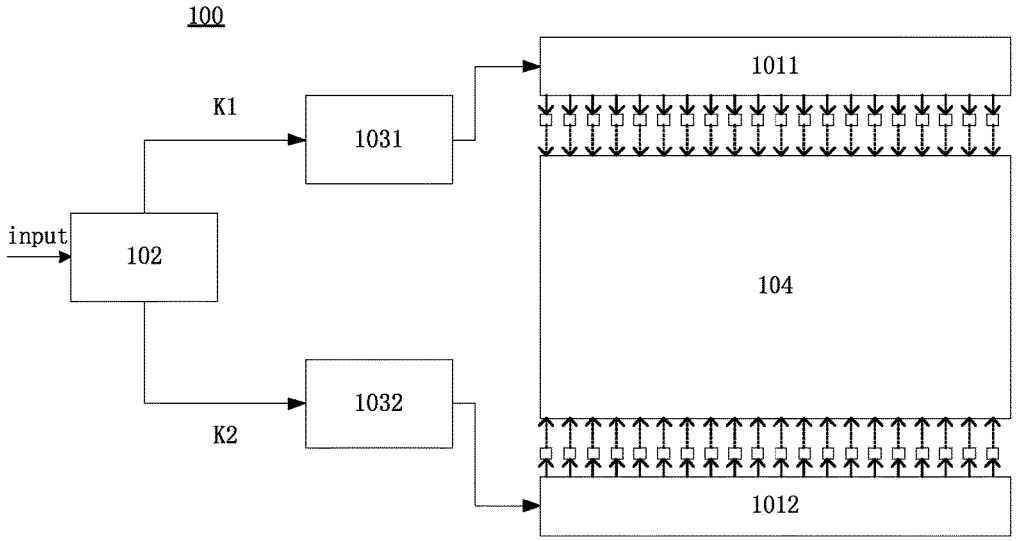
FIG. 2 illustrates a detailed diagram of the backlight device with a tunable color gamut and luminance according to the embodiment of the disclosure.

FIG. 2 illustrates a detailed diagram of the backlight device with a tunable color gamut and luminance according to the embodiment of the disclosure. As shown in FIG. 2, an input may be the requirement signals for the color gamut and the luminance expected by the user. The current feedback apparatus 102 may determine a first current feedback coefficient (K1) for the backlight apparatus with high color gamut and low luminance, and a second current feedback coefficient (K2) for the backlight apparatus with low color gamut and high luminance respectively, according to the requirement signals on chromaticity and/or luminance inputted by the user. In particular, for light sources complying with a certain specification, i.e. LED (such as, 20 mA), a plurality of tests have been performed in advance. Relationships between the luminance and/or the color gamut and the current intensity under different current intensities may be obtained, and the first current feedback coefficient K1 allocated for the backlight apparatus with high color gamut and low luminance and the second current feedback coefficient K2 allocated for the backlight apparatus with low color gamut and high luminance under the corresponding luminance and color gamut conditions may be acquired, so as to constitute a current feedback coefficient table. Then the current feedback coefficient table is stored in the storage. When the requirements for the expecting luminance or chromaticity are inputted by the user, corresponding current feedback coefficients can be derived according to the above corresponding relationships. The backlight driving apparatus 103 may include a backlight driving apparatus 1031 for the backlight apparatus with high color gamut and low luminance and a backlight driving apparatus 1032 for the backlight apparatus with low color gamut and high luminance. The backlight driving apparatuses 1031 and 1032 may supply currents to the backlight apparatus with high color gamut and low luminance 1011 and the backlight apparatus with low color gamut and high luminance 1012 to emit lights, based on the first and the second current feedback coefficients, respectively. The light guide plate 104 may mix the lights emitted from the backlight apparatus with high color gamut and low luminance and the lights emitted from the backlight apparatus with low color gamut and high luminance. Finally, the backlight of the LED display device is achieved by using the lights mixed via the light-guide plate 104 for illuminating.

As shown in FIG. 2, the backlight apparatus with high color gamut and low luminance 1011 and the backlight apparatus with low color gamut and high luminance 1012 may include a plurality of LEDs, respectively. In FIG. 2, the backlight apparatus with high color gamut and low luminance and the backlight apparatus with low color gamut and high luminance are provided on opposite sides of the display apparatus. Actually, they can also be provided on the same side of the display apparatus. In the present disclosure, there is no limitation on the specific locations of the backlight apparatus with high color gamut and low luminance and the backlight apparatus with low color gamut and high luminance. The locations can be variously set according to size and requirements of the display apparatus, as long as an uniform backlight which may meet the requirements can be provided.

The current feedback apparatus 102 can obtain instructions on the chromaticity from a terminal, and feedback different current coefficients K1 and K2 to the backlight apparatuses. The backlight apparatuses with high or low color gamut may obtain different currents based on the various current coefficients, for emitting different spectra. The spectra radiated by the backlight apparatuses based on the various current coefficients are mixed with each other, which may result in a tunable color gamut and luminance.

Figure 3:
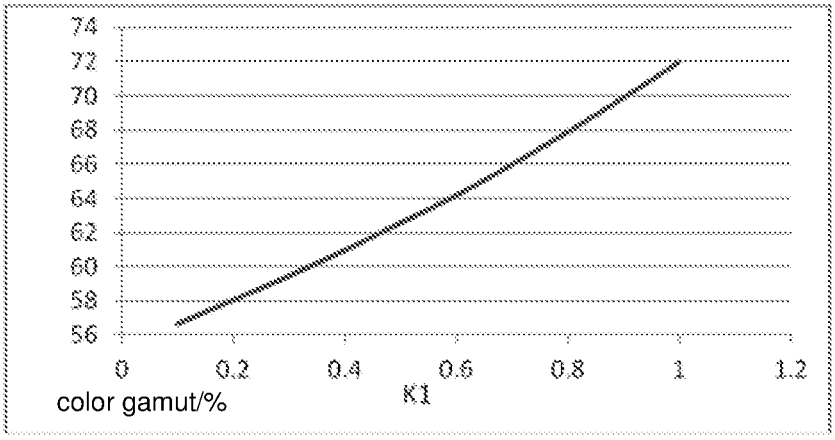
FIG. 3 illustrates a relationship between the color gamut and a current coefficient K1.
Figure 4:
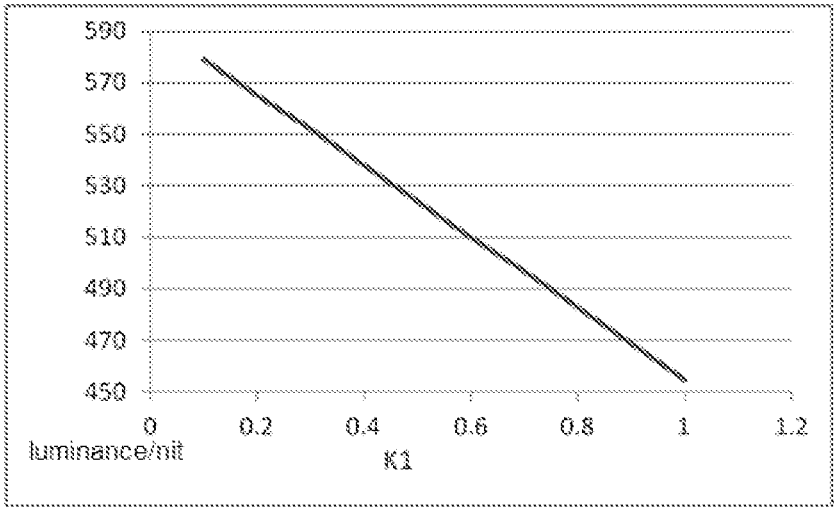
FIG. 4 illustrates a relationship between the luminance and the current coefficient K1.

FIG. 3 and FIG. 4 illustrate relationships between the color gamut and luminance, and the current coefficient K1, respectively. The first and second current coefficients K1 and K2 may be provided according to the preset scenes. K1 and K2 may conform to the same color gamut and luminance curve. By arranging K1 and K2 at different positions on the color gamut and luminance curve, a backlight source with expected color gamut and luminance may be achieved. As shown in FIGS. 3 and 4, when a total input power is a constant and the first and second current feedback coefficients are within the range of 0-1, a sum of the first and second current feedback coefficients is equal to 1 (K1+K2=1).

The currents supplied for the backlight apparatus with high color gamut and low luminance 1011 and the backlight apparatus with low color gamut and high luminance 1012 may correspond to products of the normal driving current with the first and the second current feedback coefficients, respectively. That is, the normal driving current is weighted by using K1 and K2. K1 and K2 may be complementary to each other so that the relationship between the current feedback K2 and the color gamut and luminance can be omitted.

Those skilled in the art would understand that K1+K2=1 indicates that K1 and K2 are complementary to each other when the power consumption is a constant. That is, the luminance is increased as the color gamut decreases. However, the present disclosure is not limited to the case that the power consumption is a constant. If a higher luminance and higher color gamut is required, the total power consumption may be increased. In this case, the sum of the first current feedback coefficient and the second current feedback coefficient may be greater than 1 (K1+K2>1), enabling an experience with a higher luminance. Further, if two light-emitting apparatuses (LEDs) have nearly the same color and have an enough distance in mechanic design for light mixing and color mixing, the LEDs with two color gamut can be set on the same backlight driving apparatuses, which may further cooperate with the current feedback apparatus to achieve the adjustment of the color gamut and luminance.

As shown in FIG. 3, the current coefficient K1 for the backlight apparatus with a high color gamut and a low luminance is approximately proportional to a color gamut index. The current supplied for the backlight apparatus with high color gamut and low luminance may be increased as the current coefficient K1 increases, which results in an increase of a range of the color gamut. For example, the range of the color gamut may be from 56.7% to 72%.

As shown in FIG. 4, the current coefficient K1 for the backlight apparatus with high color gamut and low luminance is approximately inversely proportional to a luminance index. The current supplied for the backlight apparatus with a high color gamut and a low luminance may be increased with the increase of the current coefficient K1, which results in a decrease of the luminance of the backlight apparatus. A high luminance LED refers to a LED which has a higher luminance when the power consumption is the same. When the power consumption is a constant, the increase of the current of the high color gamut LED means the decrease of the current of the high luminance LED. In this case, a ratio of the high luminance LED is quite low after the mixture, so that the luminance is decreased.

For example, the range of the luminance may be from 455 nit to 579 nit.

The present disclosure also provides a display device, comprising: a tunable backlight device as discussed above; and an input unit, configured to input the requirements on chromaticity and luminance. For example, the input unit may be a keyboard, a touch screen, a track point, a track ball and the like.

Figure 5:
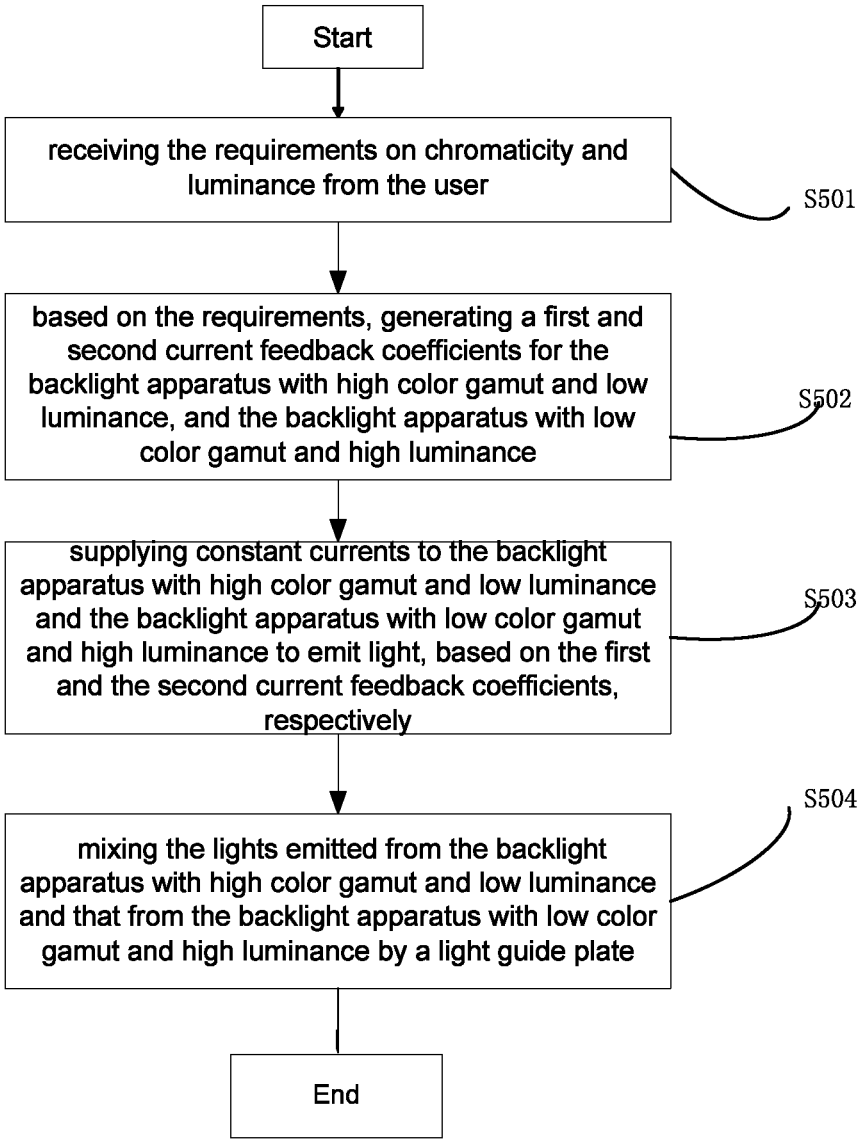
FIG. 5 illustrates a method of driving the tunable backlight device according to the embodiment of the disclosure.

FIG. 5 illustrates a method of driving the tunable backlight device according to the embodiment of the disclosure, comprising: receiving the requirements on chromaticity and luminance (S501); providing a first current feedback coefficient (K1) to the backlight apparatus with high color gamut and low luminance, and supplying a second current feedback coefficient (K2) to the backlight apparatus with low color gamut and high luminance respectively based on requirements on chromaticity and luminance (S502); supplying respective currents to the backlight apparatus with high color gamut and low luminance and the backlight apparatus with low color gamut and high luminance to emit lights, based on the first and the second current feedback coefficients, respectively (S503); and mixing the lights emitted from the backlight apparatus with high color gamut and low luminance and the lights emitted from the backlight apparatus with low color gamut and high luminance by a light guide plate (S504).

Figure 6:
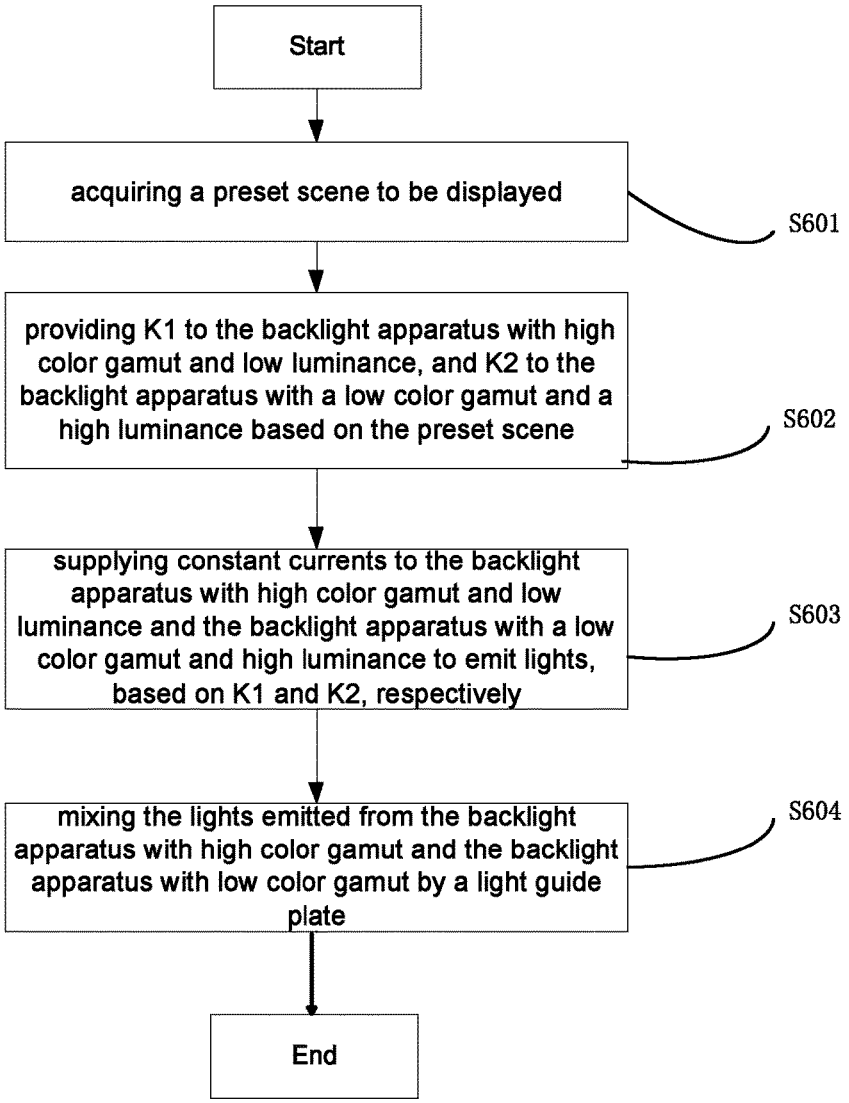
FIG. 6 illustrates a method of driving the tunable backlight device according to another embodiment of the disclosure.

FIG. 6 illustrates a method of driving the tunable backlight device according to the embodiment of the disclosure, comprising: acquiring a preset scene to be displayed (S601); providing a first current feedback coefficient (K1) to the backlight apparatus with high color gamut and low luminance, and a second current feedback coefficient (K2) to the backlight apparatus with low color gamut and high luminance respectively (S602), based on the preset scene; supplying respective currents to the backlight apparatus with high color gamut and low luminance and the backlight apparatus with low color gamut and high luminance to emit lights, based on the first and the second current feedback coefficients, respectively (S603); and mixing the lights emitted from the backlight apparatus with high color gamut and low luminance and the lights emitted from the backlight apparatus with low color gamut and high luminance by a light guide plate (S604).

By using the tunable backlight device and the driving method thereof according to the present application, a backlight device with a tunable color gamut and luminance may be achieved in a low-cost way, so as to meet the user demands under different situations.

The present disclosure is described above with reference to the embodiments thereof. However, those skilled in the art should understand that various alternations and modifications can be made to the embodiments without departing from the scope and the spirit of the disclosure which is defined by the attached claims.

We claim:

1. A tunable backlight device, comprising:

at least one backlight apparatus with high color gamut and low luminance;

at least one backlight apparatus with low color gamut and high luminance;

a storage, configured to store a library of current feedback coefficients;

a processor configured to receive feedback coefficients from the library of current feedback coefficients, determine a first current feedback coefficient (K1) for the backlight apparatus with high color gamut and low luminance, and a second current feedback coefficient (K2) for the backlight apparatus with low color gamut and high luminance, according to requirements on chromaticity and luminance, wherein the requirements on the chromaticity and luminance for a preset scene are stored in advance;

a backlight driving apparatus configured to supply currents to the backlight apparatus with high color gamut and low luminance and the backlight apparatus with low color gamut and high luminance to enable light emission, based on the first and the second current feedback coefficients from the processor, respectively; and a light guide plate configured to mix the lights emitted from the backlight apparatus with high color gamut and low luminance and the lights emitted from the backlight apparatus with low color gamut and high luminance;

wherein in response to a total input power being a constant, a sum of the first current feedback coefficient and the second current feedback coefficient is equal to 1.

2. The tunable backlight device of claim 1, further comprising performing a plurality of tests on the backlight apparatus with high color gamut and low luminance or the backlight apparatus with low color gamut and high luminance in advance, to obtain a relationship between the luminance and/or the color gamut under different current intensities and the current as the library of current feedback coefficients; and storing the library of current feedback coefficients in the storage; and retrieving feedback coefficients from the library of current feedback coefficient according to the desired requirements on the luminance or chromaticity.

3. The tunable backlight device of claim 1, wherein a light source provided in the backlight apparatus with high color gamut and low luminance and a light source provided in the backlight apparatus with low color gamut and high luminance is the same light-emitting diode.

4. The tunable backlight device of claim 1, wherein a light source provided in the backlight apparatus with high color gamut and low luminance and a light source provided in the backlight apparatus with low color gamut and high luminance are different light-emitting diodes.

5. The tunable backlight device of claim 1, wherein the requirements on the color gamut and the luminance are inputted by a user.

6. The tunable backlight device of claim 1, wherein the first current feedback coefficient and the second current feedback coefficient are within a range of 0-1.

7. The tunable backlight device of claim 1, wherein in response to a total input power being increased, a sum of the first current feedback coefficient K1 and the second current feedback coefficient K2 is greater than 1.

8. The tunable backlight device of claim 1, wherein a range of the color gamut is from 56.7% to 72%.

9. The tunable backlight device of claim 1, wherein a range of the luminance is from 455 nit to 579 nit.

10. The tunable backlight device of claim 1, wherein the currents supplied for the backlight apparatus with high color gamut and low luminance and the backlight apparatus with low color gamut and high luminance correspond to products of a normal driving current by the first and the second current feedback coefficients, respectively.

11. A display device, comprising:

the tunable backlight device of claim 1; and an input device configured to input requirements on chromaticity and luminance.

12. A method of driving a tunable backlight device, comprising:

receiving requirements on chromaticity and luminance;

generating a first current feedback coefficient (K1) to a backlight apparatus with high color gamut and low luminance, and a second current feedback coefficient (K2) to a backlight apparatus with low color gamut and high luminance respectively, based on the requirements on chromaticity and luminance;

supplying currents to the backlight apparatus with high color gamut and low luminance and the backlight apparatus with low color gamut and high luminance to emit lights, based on the first and the second current feedback coefficients, respectively; and mixing the lights emitted from the backlight apparatus with high color gamut and low luminance and the lights emitted from the backlight apparatus with low color gamut and high luminance by a light guide plate;

wherein in response to a total input power being a constant, a sum of the first current feedback coefficient and the second current feedback coefficient is equal to 1.

13. A method of driving a tunable backlight device, comprising:

acquiring a preset scene to be displayed;

providing a first current feedback coefficient (K1) to a backlight apparatus with high color gamut and low luminance, and second current feedback coefficient (K2) to a backlight apparatus with low color gamut and high luminance respectively, based on the preset scene;

supplying respective currents to the backlight apparatus with high color gamut and low luminance and the backlight apparatus with low color gamut and high luminance to emit lights, based on the first and the second current feedback coefficients, respectively; and mixing the lights emitted from the backlight apparatus with high color gamut and low luminance and the lights emitted from the backlight apparatus with low color gamut and high luminance by a light guide plate;

wherein in response to a total input power being a constant, a sum of the first current feedback coefficient and the second current feedback coefficient is equal to 1.

* * * * *